United States Patent [19]

Clarke

[11] Patent Number: 4,918,429

[45] Date of Patent: Apr. 17, 1990

[54] DISPLAY SYSTEM WITH SYMBOL FONT MEMORY

[75] Inventor: David A. Clarke, Eastleigh, United Kingdom

[73] Assignee: International Business Machines Corporation, Armonk, N.Y.

[21] Appl. No.: 114,254

[22] Filed: Oct. 26, 1987

[30] Foreign Application Priority Data

Apr. 2, 1987 [GB] United Kingdom ..... 8707849

[51] Int. Cl.[4] ..... G09G 1/00

[52] U.S. Cl. ..... 340/790; 340/798; 340/799

[58] Field of Search ..... 340/735, 747, 750, 789, 340/790, 798, 799; 364/200, 900

[56] References Cited

U.S. PATENT DOCUMENTS

| | | | |
|---|---|---|---|
| 4,308,532 | 12/1981 | Murphy | 340/750 |
| 4,400,697 | 8/1983 | Currie et al. | 340/790 |
| 4,486,856 | 12/1984 | Heckel et al. | 340/798 |
| 4,679,038 | 7/1987 | Bantz et al. | 340/747 |
| 4,686,525 | 8/1987 | Nagata | 340/735 |
| 4,718,024 | 1/1988 | Guttag et al. | 340/747 |
| 4,752,893 | 6/1988 | Guttag et al. | 340/747 |

OTHER PUBLICATIONS

Canton, D. A., IBM Technical Disclosure Bulletin, vol. 25, No. 2, Jul. 1982, p. 843.

*Primary Examiner*—Gerald Brigance
*Assistant Examiner*—Richard Hjerpe
*Attorney, Agent, or Firm*—Jack M. Arnold; J. David Ellett, Jr.

[57] ABSTRACT

In a display system of the type where one or more symbol tables 20 are stored in general purpose storage and include blocks of data forming symbol definitions for each of a set of symbols, and an all points addressable (APA) display buffer 30 is provided which includes on-screen APA storage 32 for data indicative of pels to be displayed on a screen and off-screen APA storage 34 for symbol definitions with buffer control logic 36 for associating symbol definitions in off-screen APA storage with locations in on-screen APA storage such that symbols are displayed at desired locations on the display screen, cache control logic 42 is provided for copying the definition of a symbol for display from the symbol table in general purpose storage to off-screen APA storage if the definition for the selected symbol is not already held in off-screen APA storage, whereby the off-screen APA storage is configured as a cache for holding definitions for selected symbols. A cache table 40 is provided in general purpose storage and comprises an entry for each symbol in the symbol set for pointing to the location in off-screen APA storage, if any, at which the corresponding symbol definition is held, each entry in the cache table also being associated with the location in the symbol table at which the corresponding symbol definition is stored.

8 Claims, 7 Drawing Sheets

DISPLAY SYSTEM WITH SYMBOL FONT MEMORY

BACKGROUND OF THE INVENTION

The present invention relates to a display system in which symbols are generated on a screen by copying blocks of pixels representing the symbols from general purpose storage into a display buffer.

Display systems in which symbols are generated on a screen in this way may take many different forms. One possible form is that of a workstation such as personal computer. It is common for the display of a workstation to be a raster scanned display device such as a cathode ray tube device (CRT) which requires a refresh (or display) buffer. In many prior art systems the display buffer is in practice a part of the workstation's random access memory (RAM) in the sense that it is within the address space of the workstation processor. This is not always the case though. Either way, it is usual to configure the display buffer as an all points addressable (APA) buffer (ie. each item of pel data can be separately accessed) in order that a sufficiently high data bandwidth can be achieved in order to support the display while still allowing the buffer to be updated.

Whether the display buffer is part of the workstation RAM or is physically separate, the relatively high cost of configuring storage as an APA buffer compared to general purpose RAM or ROM means that it is desirable to keep the display buffer as small as possible.

A low cost prior approach to the problem of how to add symbols to the display when updating it is that adopted in standard personal computers with a color graphics adapter (CGA). In this sort of computer a symbol table containing each of the symbol definitions for a set of symbols is stored in general purpose ROM, and each time a symbol is selected for display on the screen in APA mode, the block of pels forming the definition for that symbol is copied from the symbol table into an APA display buffer. This approach has the disadvantage, however, that it is relatively slow.

An alternative, prior, approach which provides increased performance at increased cost is to provide a APA display buffer which includes both on-screen APA storage for the pel data forming a screen of data for display and off-screen APA storage for a symbol table with the symbol definitions for each of the symbols of a symbol set. Special purpose hardware is provided for copying the symbol definitions from the off-screen to the on-screen parts of the display buffer. This approach, which was adopted, for example, in the IBM 3270PC/GX and IBM 3270PC-AT/GX personal computers has the disadvantage that it requires the APA display buffer to be larger, and is consequently more expensive than that in a standard personal computer. Although this approach is more efficient than the former one, it is not as efficient in many applications as might at first be expected. The reason for this is that in applications such as document preparation in general and desk-top publishing in particular, it is necessary to provide a number of different symbol sets (eg. different character fonts). As it is not viable to provide a display buffer which is large enough to accommodate all the symbol fonts at one time, the compromise was adopted to provide storage in the APA display buffer for one complete storage font and to load the symbol table required for a selected font from general purpose RAM each time a font change is required. This process is time consuming and presents a significant system overhead when many font changes are required.

A similar approach to the last mentioned one has been adopted in personal computers including so-called enhanced graphics adapters (EGAs) in that a selected symbol font is transferred into an off-screen portion of an APA display buffer, although the details of the management of the buffer is different. Rather than copying symbol definitions from the off-screen to the on-screen portions of the buffer, pointers to the definitions are instead stored in the on-screen portion and data from the on-screen and the off-screen portions are then merged in order to refresh the display. In the same way as in the last mentioned approach, the copying of a symbol table every time a font change is required is time consuming and presents a significant system overhead when many font changes are required.

The disadvantages of the prior art are overcome by a display system in accordance with the present invention, in which are provided a symbol table in general purpose storage which includes blocks of data forming symbol definitions for each of a set of symbols forming a desired symbol set, an all points addressable (APA) display buffer which includes on-screen APA storage for data indicative of pels to be displayed on a screen and off-screen APA storage for symbol definitions, and buffer control logic for associating symbol definitions in off-screen APA storage with locations in on-screen APA storage such that symbols are displayed at desired locations on the display screen, wherein the display system additionally comprises cache control logic for copying the definition of a symbol for display from the symbol table in general purpose storage to off-screen APA storage if the definition for the selected symbol is not already held in off-screen APA storage, whereby the off-screen APA storage is configured as a cache for holding definitions for selected symbols.

A display system in accordance with the present invention enables increased performance to be achieved at reasonable cost in that the advantages of special purpose buffer control logic can be exploited without large off-screen APA storage requirements and heavy processing overheads.

In a particular embodiment of a display system in accordance with the invention there is additionally provided in general purpose storage a cache table comprising an entry for each symbol in the symbol set for pointing to the location in off-screen APA storage, if any, at which the corresponding symbol definition is held, each entry in the cache table also being associated with the location in the symbol table at which the corresponding symbol definition is stored.

As a plurality of display fonts are provided in this particular embodiment, a plurality of symbol tables for different symbol sets are stored in general purpose storage and the display system is provided with pointer means under the control of the cache control logic for associating the cache table with the symbol table for the desired symbol set.

In this particular embodiment, the cache control logic can be arranged to interrogate the cache table when a selected symbol is to be added to the display in order to identify the location, if any, at which the definition for the selected symbol is held in off-screen APA storage, to cause the buffer control logic to associate the selected symbol definition in off-screen APA storage with the on-screen APA storage such that the symbol is displayed at a desired location on the display screen, otherwise to copy the definition for the selected symbol from the appropriate symbol table entry in general purpose storage to a free location in off-screen APA storage, to store an indication in the appropriate entry in the cache table of the location in off-screen APA storage at which the definition for that symbol is now held and to cause the buffer control logic to associate the selected definition in off-screen APA storage with the on-screen APA storage such that the symbol is displayed at the desired location on the display screen.

DISCLOSURE OF THE INVENTION

A display system of the type in which one or more symbol tables are stored in general purpose storage, and includes blocks of data forming symbol definitions for each of a set of symbols. An all points addressable (APA) display buffer is provided which includes on-screen APA storage for data indicative of pels to be displayed on a screen and off-screen APA storage for symbol definitions with buffer control logic for associating symbol defintions in off-screen APA storage with locations in on-screen APA storage such that symbols are displayed at desired locations on the display screen. A cache control logic is provided for copying the definition of a symbol for display from the symbol table in general purpose storage to off-screen APA storage if the definition for the selected symbol is not already held in off-screen APA storage, whereby the off-screen APA storage is configured as a cache for holding definitions for selected symbols. A cache table is provided in general purpose storage and comprises an entry for each symbol in the symbol set for pointing to the location in off-screen APA storage, if any, at which the corresponding symbol definition is held. Each entry in the cache table is also associated with the location in the symbol table at which the corresponding symbol definition is stored.

BEST MODE FOR CARRYING OUT THE INVENTION

Figure 1:
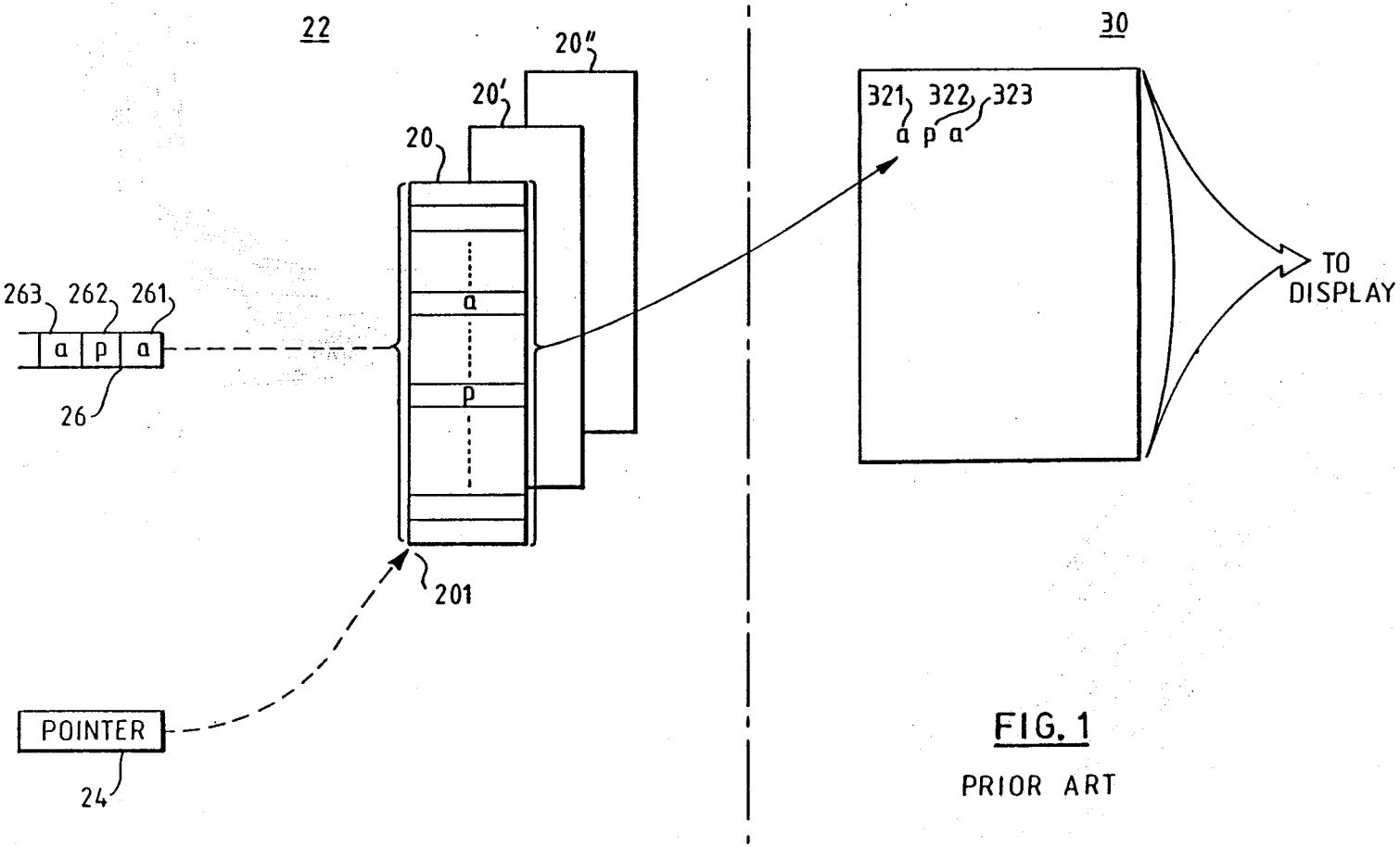
FIG. 1 PRIOR ART
FIG. 1 is a schematic diagram of aspects of a first prior art display system.

FIG. 1 is a schematic block diagram showing certain aspects of a prior art display system. The display system in question is a conventional personal computer including a color graphics adapter (CGA). As the structure of such computers are well known in the art, only those aspects which are relevant to the present description have been shown. A symbol table 20, 20', 20'', etc is stored in the general purpose random access memory (RAM) 22 of the computer for each of a number of symbol sets (eg. different symbol fonts). Each symbol table (eg. 20) contains a definition of each of the 256 symbols in the set in terms of a pel (or pixel) map of the symbol needed to generate the symbol on a display screen (not shown). In order to select the symbol table which is currently in use, a pointer 24 is stored in the general purpose RAM as well. A display buffer 30 is provided for containing the pel information which is used to generate an image on the display device of the personal computer. This buffer is provided as part of the random access memory in the sense that it is within the address space of the personal computer's processor, but it is configured as an APA buffer. The data stored in the display buffer is read out in synchronism with the scanning of the display screen. In this Figure, and also FIGS. 2 to 5 solid arrows have been used to indicate data transfer paths and arrows with dashed lines have been used to indicate pointing or addressing paths.

In operation, each time a symbol set is selected, the pointer 24 is set to point to the bottom 201 of the appropriate symbol table 20. Then, when a symbol string 26 is to be added to the display screen at locations 321, 322, 323, the block of pels forming the definition for each of the symbols a,p,a in the string is copied from the appropriate symbol table into the display buffer. Each symbol in the symbol stream is represented by a code 261, 262, 263 which, in combination with the pointer is used to address the appropriate location for that symbol in the selected symbol table. This approach has the disadvantage, however, that it is relatively slow as the bandwidth of the path from the symbol table to the display buffer is limited.

Figure 2:
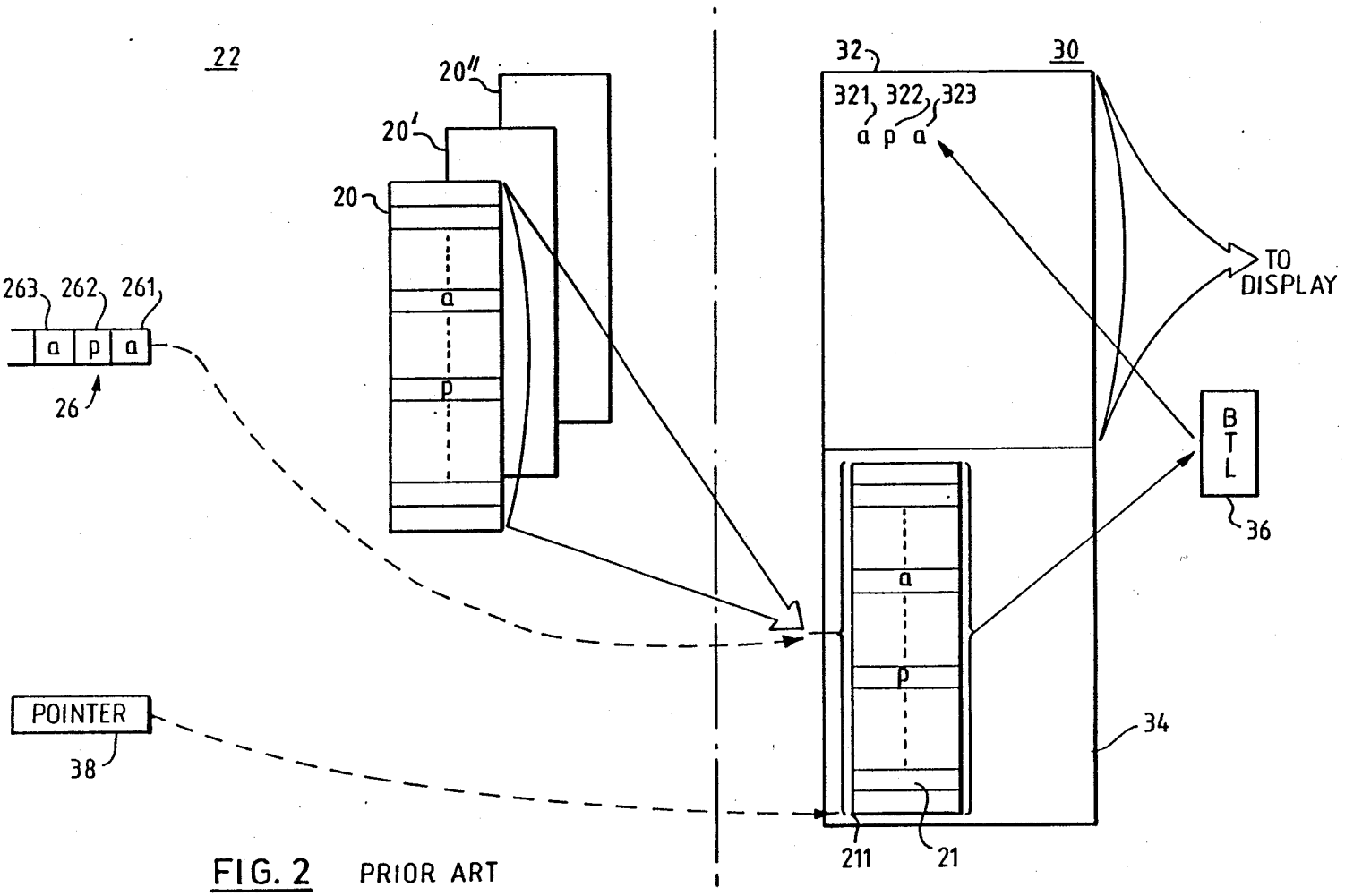
FIG. 2 PRIOR ART
FIG. 2 is a schematic diagram of aspects of a second prior art display system.

FIG. 2 is a schematic block diagram of a second prior art display system. This display system is a personal computer such as an IBM 3270PC/GX or an IBM 3270PC-AT/GX which is provided with a more sophisticated graphics adapter. As the general structure of such computers are well known in the art, only those aspects which are relevant to the present description have been shown. In this computer, a symbol table 20, 20', 20'', etc is stored in the general purpose random access memory (RAM) 22 for each of a number of symbol sets in the same way as in the FIG. 1 system. Once again each symbol table (eg. 20) contains a definition of each of 256 symbols in the set in terms of a pel map of the symbol as it would appear when displayed on a display screen (not shown). A display buffer 30 is also provided as part of the random access memory in the sense that it is within the address space of the personal computer's processor, but it is configured as an APA buffer. In this prior system however, the display buffer includes both on-screen APA storage 32 for the pel data forming a screen of data for display and additionally off-screen APA storage 34 for a symbol table 21 with the symbol definitions for each of the symbols of a symbol set. Moreover, special purpose block transfer hardware 36 is provided for copying the symbol definitions from the off-screen to the on-screen parts of the display buffer.

In operation, each time a symbol set is selected, the full symbol table for that desired font is copied from the general purpose RAM to the off-screen storage part of the display buffer. A pointer 34, which is held in general purpose RAM, is set to point to the location 211 at which the selected font table starts in the off-screen storage part of the display buffer. Then, when a symbol string 26 is to be added to the display screen at locations 321, 322, 323 the block transfer logic copies the block of pels forming the definition for each of the symbols a, p, a in the string from the off-screen to the on-screen part of the display buffer. Each symbol in the symbol stream is represented by a code 261, 262, 263 which, in combination with the pointer 38 is used to address the appropriate location for that symbol in the symbol table held in off-screen APA storage. The bandwidth provided for the transfer of symbol definitions between the off-screen and the on-screen parts of the APA display buffer by the special purpose hardware is high so that the display of individual symbols is very rapid. However, because of the limited bandwidth between the general purpose RAM and the off-screen part of the display buffer, the copying of the symbol table each time a font change occurs is very time consuming. This presents a significant system overhead when many font changes are required, for example in desk top publishing applications and other document preparation applications.

Figure 3:
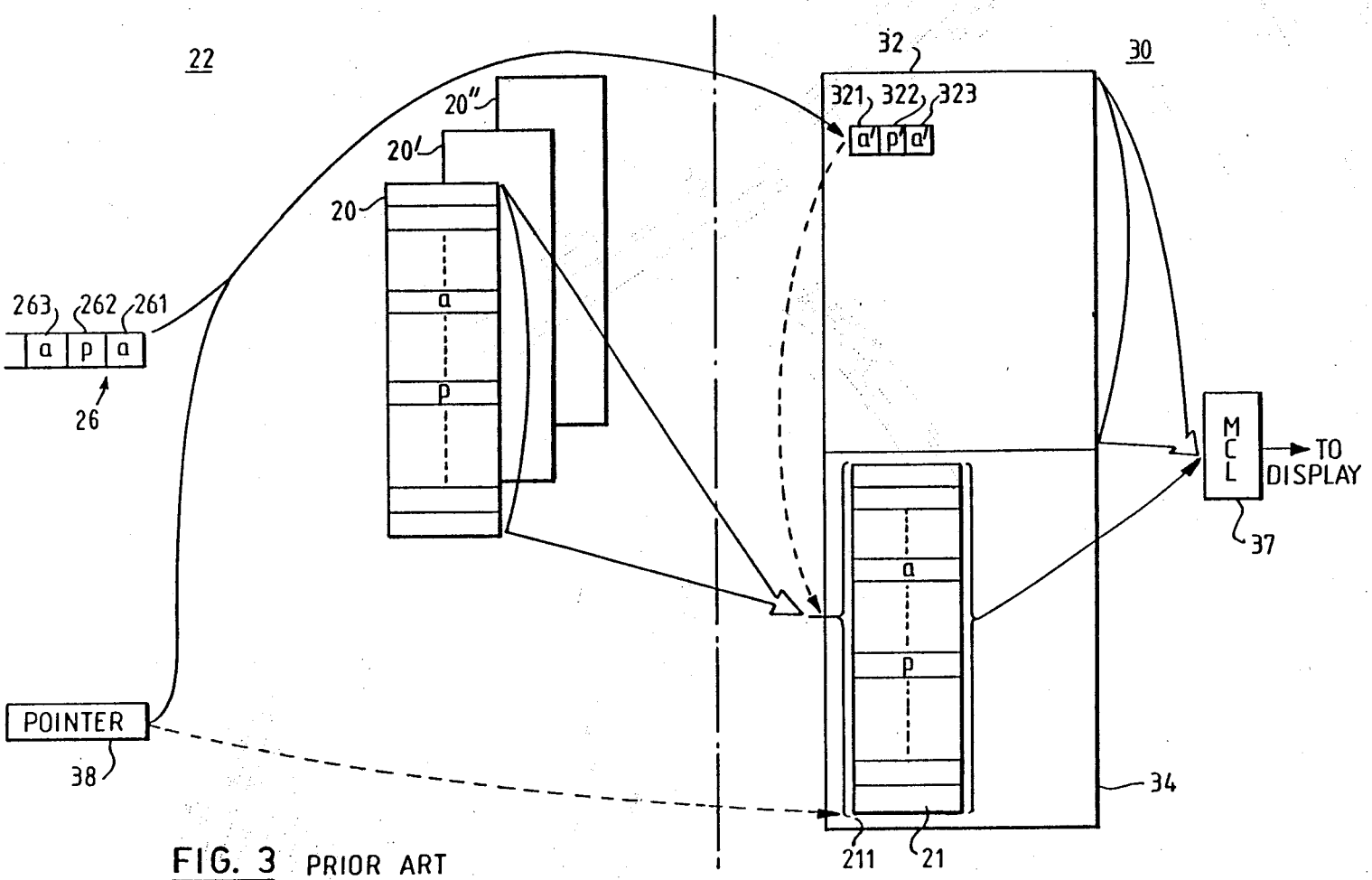
FIG. 3 PRIOR ART
FIG. 3 is a schematic diagram of aspects of a third prior art display system.

FIG. 3 is a schematic block diagram of a third prior art display system. This display system is a personal computer provided with an Enhanced Graphics Adapter or EGA. This computer is generally similar to the prior art display system shown in FIG. 2. A different approach to the organization of the APA display buffer is, however, adopted. The display buffer includes both on-screen APA storage 32 indicative of pels to be displayed on the display screen and off-screen APA storage 34 for a symbol table 21 with the symbol definitions for each of the symbols of a symbol set. The on-screen APA storage does not contain the actual pel information for the symbols to be displayed, but rather contains pointers a', p', a' to the symbol definitions in the off-screen APA storage. Special purpose merge control hardware 37 is provided for merging the data output from the on-screen and the off-screen APA parts of the display buffer to form the data stream for generating the display.

The operation of this system can be summarized as follows. Each time a symbol set, or font is selected, the full symbol table for that desired set, or font is copied from the general purpose RAM to the off-screen storage part of the display buffer. A pointer 38, which is held in general purpose RAM, is set to point to the location 211 at which the selected symbol table starts in the off-screen storage part of the display buffer. Then, when a symbol string 26 is to be added to the display screen at locations 321, 322, 323 pointers a', p', a' are stored at appropriate locations in the on-screen part of the display buffer using the codes 261, 262, 263 for the respective symbols in combination with the pointer 38. When the display is refreshed, the pointers in the on-screen part of the APA display buffer are used by the merge control logic to select the symbol definitions for display from the off-screen part of the APA display buffer. This display system suffers from the same problems as the FIG. 2 system because of the limited bandwidth between the general purpose RAM and the off-screen part of the display buffer which means that the copying of the full symbol table each time a font change occurs is very time consuming.

Figure 4:
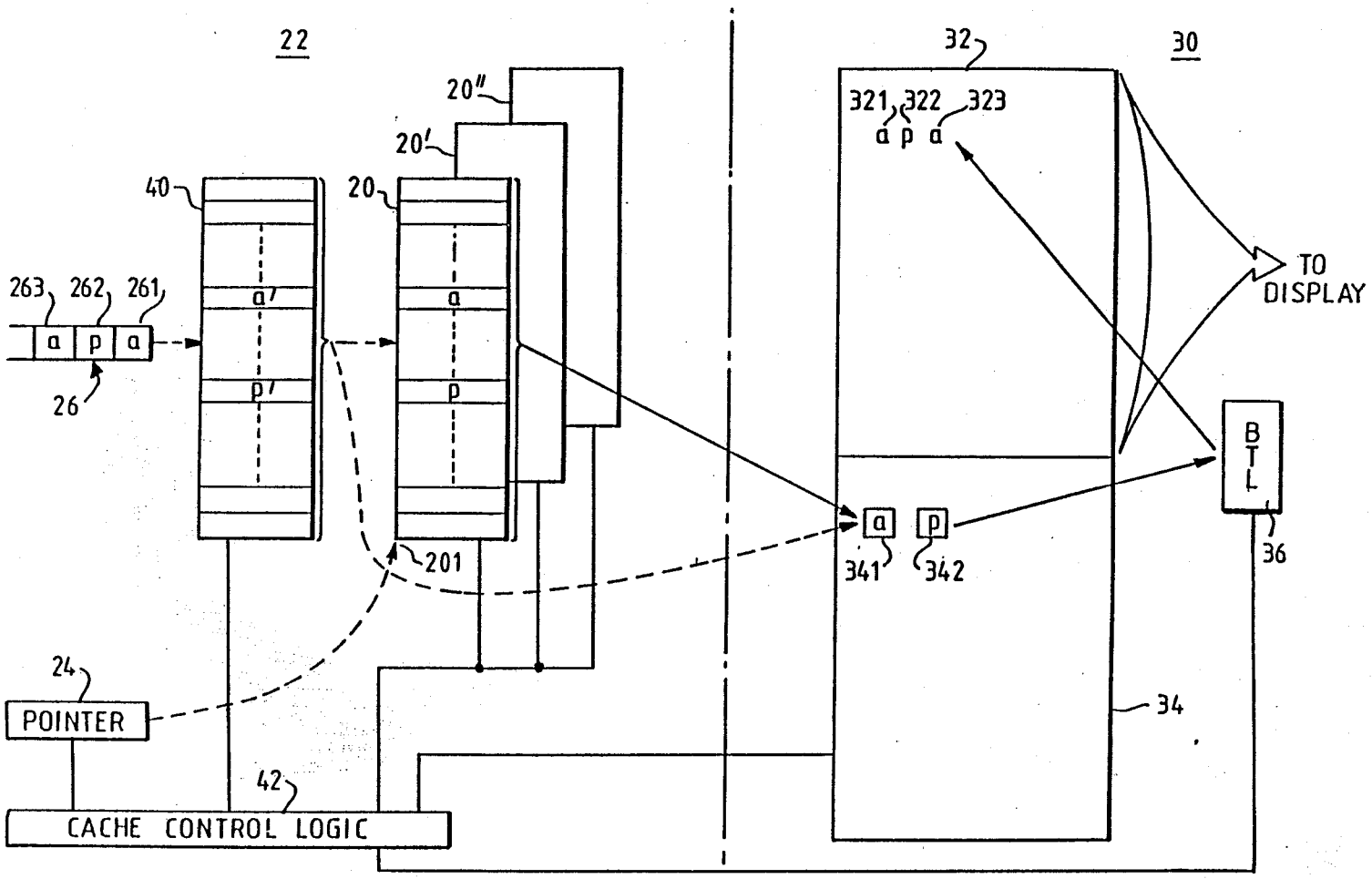
FIG. 4 is a schematic diagram of aspects of a first display system in accordance with the present invention.

The present invention does not suffer from the disadvantages of the prior art. FIG. 4 is a schematic block diagram of aspects of a particular embodiment of a display system in accordance with the present invention. The display system comprises a symbol table 20, 20', 20'', etc for each of a number of symbol sets. The symbol sets can be, for example, different character sets or fonts. The symbol tables are stored in the general purpose memory of the display system. Normally the symbol tables are stored in general purpose random access memory. They could, however, be stored in another general purpose memory such as a read only memory. The basic principle is that the storage for the symbol sets is comparatively inexpensive and plentiful. As in the prior art systems, each symbol table (eg. 20) contains a definition of each of the symbols in the set in terms of a block of pels forming a pel map of the symbol as it would appear when displayed on a display screen (not shown). Each set will normally comprise 256 symbols, although the sets can be larger or smaller as required. In order to indicate which symbol table is currently in use, a pointer 24 is provided. An APA display buffer 30 is provided which includes both on-screen APA storage 32 for data indicative pels to be displayed on a screen and off-screen APA storage 34 for a symbol table with the symbol definitions for each of the symbols of a symbol set. Also, in the same way as in the prior system illustrated in FIG. 2, special purpose hardware 36 is provided for copying the symbol definitions from the off-screen to the on-screen parts of the display buffer. In addition to the elements mentioned above, the display system illustrated in FIG. 4 also comprises a cache table 40 and cache control logic 42. The cache control logic is used to configure the off-screen APA storage, or part thereof, as a cache for the definitions of individual symbols that have been selected for display. The cache table comprises an entry (e.g. 2 bytes long) for each symbol in a selected symbol set for pointing to the location in said off-screen storage, if any, at which the corresponding symbol definition is stored.

The operation of the display system shown in FIG. 4 will be explained with reference to the flow diagram in FIG. 6. As the stream of symbols to be added to the display is received, a check is made to see if a symbol set, or font change is required (block 90). If a new symbol font is selected (block 91), the cache control logic resets the cache table and the associates the cache table with the symbol table for the selected font by setting the pointer 24 to point to the base 201 of that symbol table. The cache table has the same number of entries (eg. 256) as the symbol tables whereby each entry in the cache table can be associated with a particular symbol definition in the table for the selected font. The effect of resetting the cache table is that symbol definitions can only be accessed from the symbol table which is identified by the pointer. Any symbol definitions which were previously stored in the off-screen area of the display buffer need not be erased as such, they just cannot be accessed because the pointers in the cache table have been erased.

FIG. 4 shows the first three symbols a, p, a in a symbol stream 26 which is to be displayed on the display screen. Each symbol in the stream is represented by a code 261, 262, 263 which is used to address the cache table.

For each successive symbol in the stream, the cache control logic interrogates the entry in the cache table identified by the code representing each said symbol (block 92).

If the particular symbol represented by the received code has been used since the cache table was reset, there will be a pointer (a', p') to an off-screen display buffer location stored in the appropriate location in the cache table and the control logic will know that the block of pel data forming the definition for that symbol is to be found in the off-screen display buffer location pointed to by the content of the appropriate location in the cache table. In this case the control logic causes (block 96) the block transfer logic to copy the block of pel data which was previously stored in the location in off-screen storage pointed to into the on-screen storage.

If, on the other hand, the particular symbol represented by the received code has not been used since the cache table was reset, there will be no pointer (a', p') in the appropriate entry in the cache table pointing to the off-screen display buffer and the control logic will know that the definition for that symbol is to be found in the corresponding location in the currently operative symbol table 20 as identified by the pointer 24. In this case, the cache control logic tests (block 93) whether the cache is full. If the cache is full, the control logic resets the cache table (block 94). The effect of resetting the cache table is that the first time any particular symbol is to be added to the display following the resetting operation, the corresponding definition can only be accessed from the symbol table which is identified by the pointer. Consequently, the symbol definitions which were previously stored in the off-screen area of the display buffer need not be erased as such.

If the cache table was not full, or following a resetting operation, the cache control logic then causes (block 95) the block of pel data forming the definition for the selected symbol to be copied from the appropriate entry in the symbol table identified by the pointer 24 to a free location 341, 342 the off-screen storage and causes a pointer to this free location to be stored in the appropriate entry in the cache table. The cache control logic then causes (block 96) the block transfer logic 36 to copy the block of pel data which has just been stored in the off-screen storage into the on-screen storage.

If there is a further symbol to be processed (block 97) the cache control logic repeats the steps mentioned above.

Figure 5:
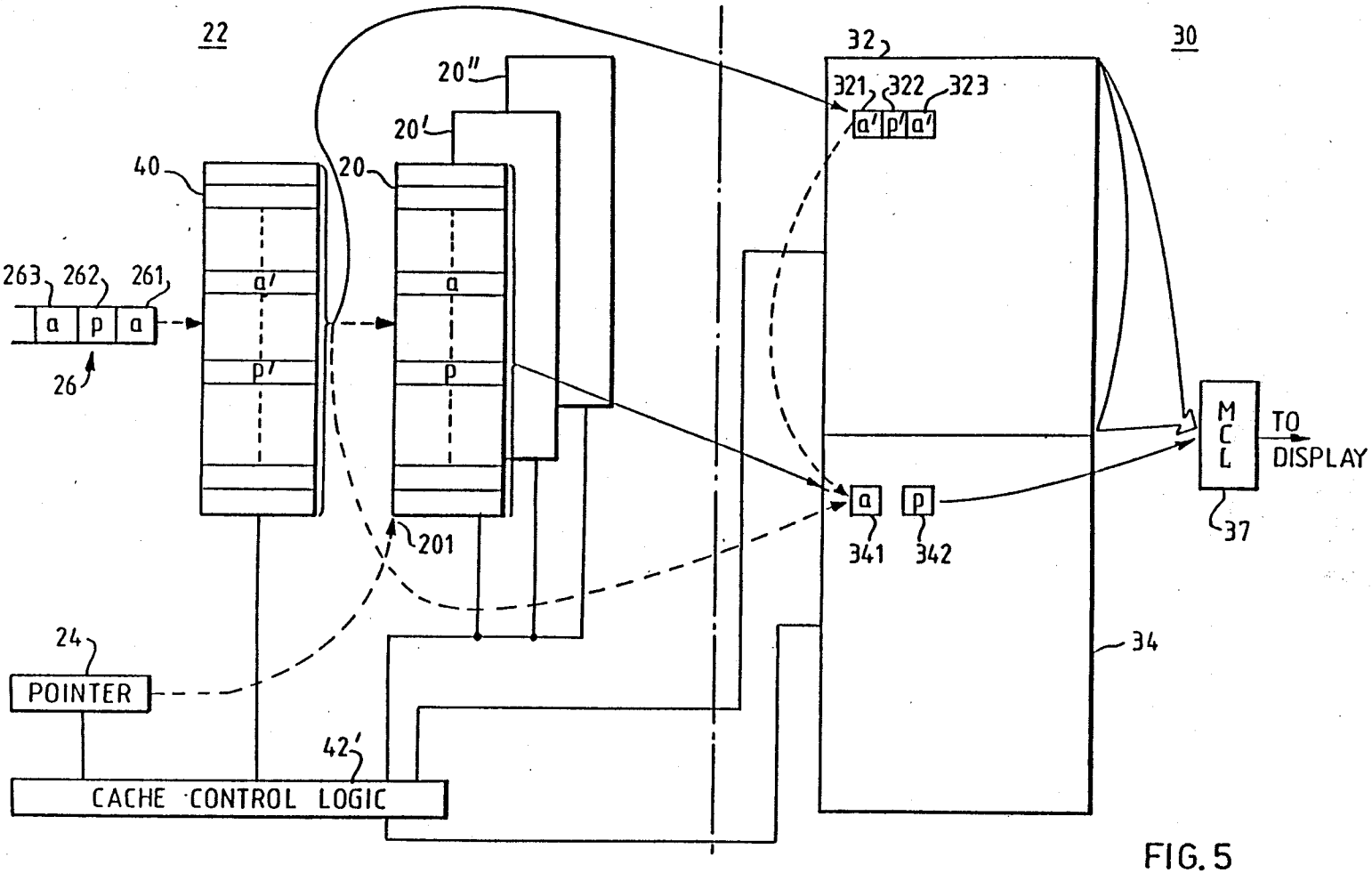
FIG. 5 is a schematic diagram of aspects of a second display system in accordance with the present invention.

FIG. 5 is a schematic block diagram of a second display system in accordance with the invention. This display system is generally similar to the system shown in FIG. 4, but with special purpose merge control logic for the APA display buffer along the lines of that in the FIG. 3 prior art system rather than block transfer logic. The on-screen APA storage does not contain the actual pel information for the symbols to be displayed, but rather contains pointers a', p', a' to blocks of pel data forming symbol definitions at 341, 342 in the off-screen APA storage. Unlike the FIG. 3 prior art system, however, a complete symbol table is not copied from general purpose storage to the off-screen part of the display buffer. Instead the off-screen APA storage is configured as a cache by cache control logic 42.

Figure 6:
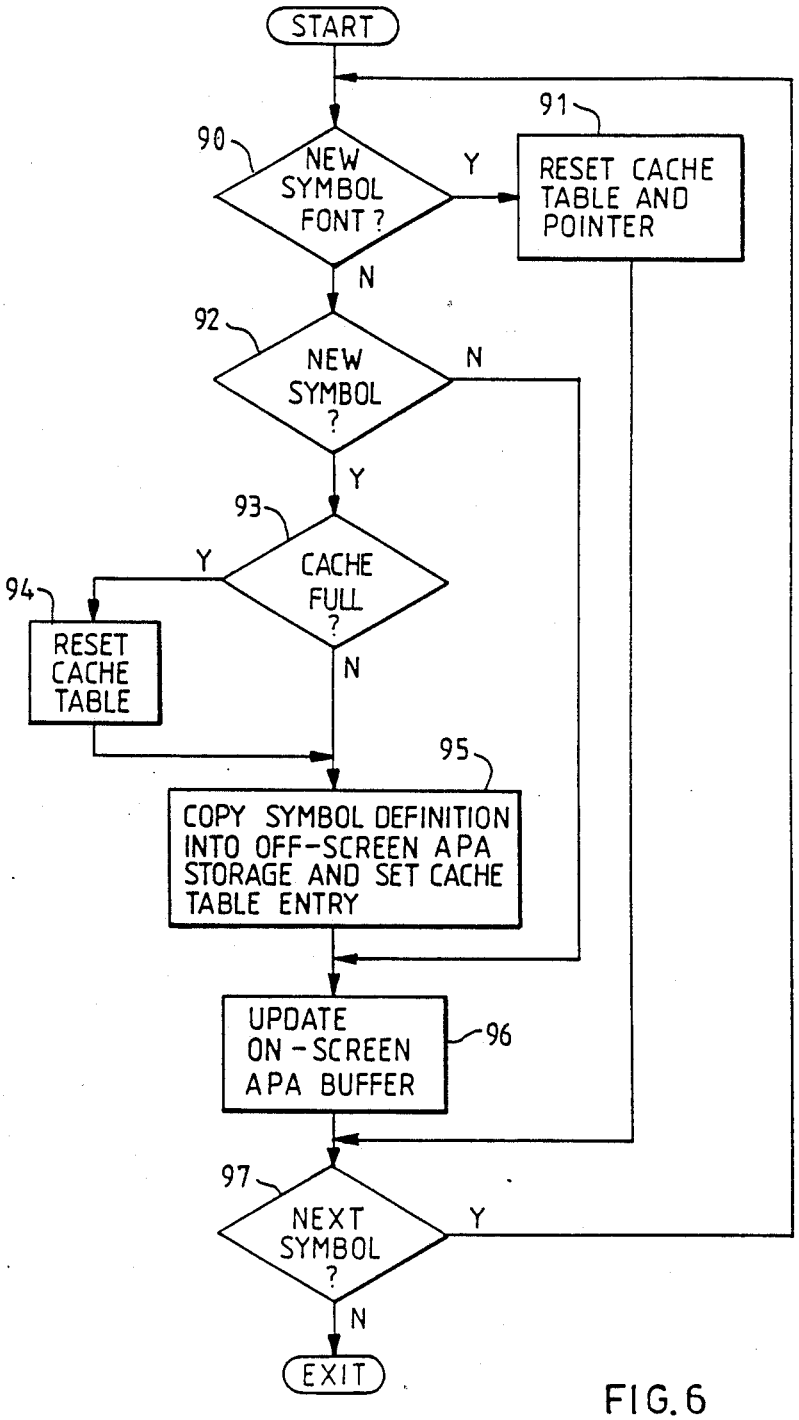
FIG. 6 is a flow diagram presenting an overview of the operation of the display systems of FIGS. 4 and 5.

The cache control logic 42' in this embodiment operates as described above for the FIG. 4 embodiment of the invention, with exception of the operations to be performed in block 96 in FIG. 6. The step of updating the buffer in this embodiment comprises the cache control logic causing a pointer 24 to the symbol definition in off-screen APA storage to be written into on-screen APA storage such that, on subsequent scans of the on-screen APA storage, the merge logic causes the symbol to be reproduced at the appropriate location on the display. The pointer a', p', to be inserted in a particular on-screen location is the same as the pointer in the cache table for the symbol in question.

Figure 7:
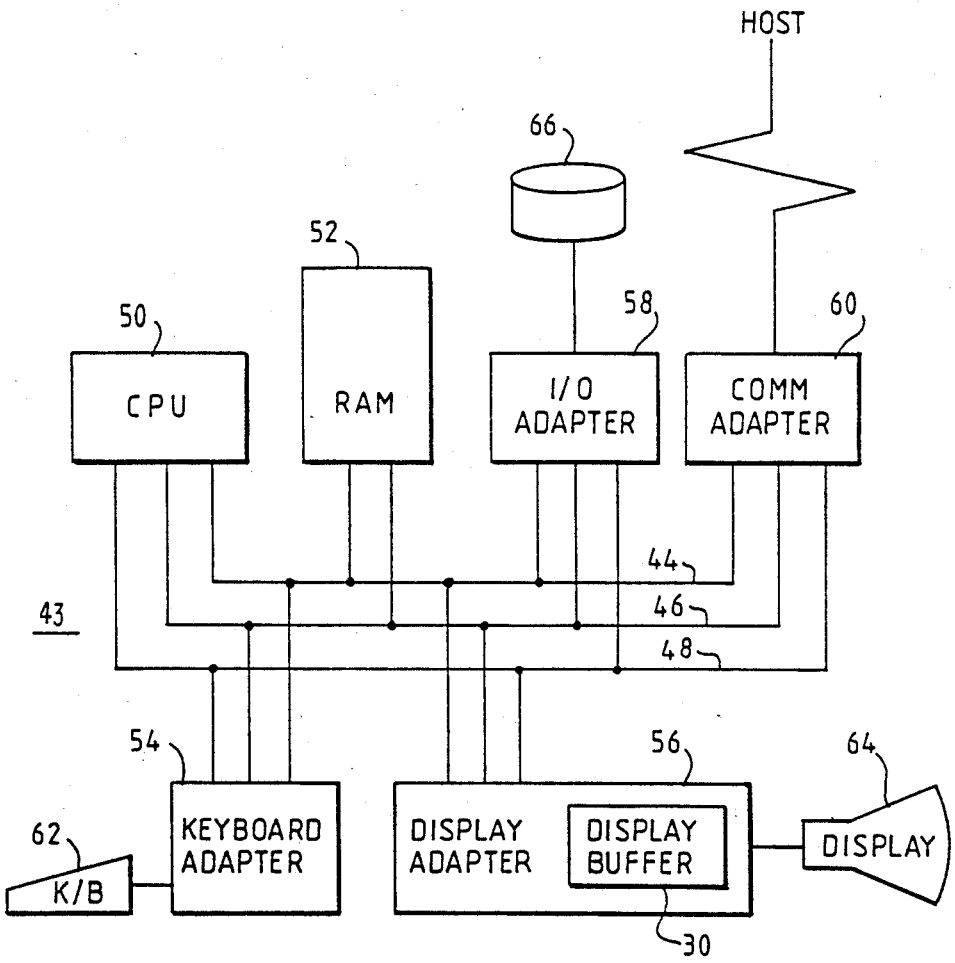
FIG. 7 is a block diagram of a specific implementation of the display adapters of FIGS. 4 and 5 in the form of a workstation.

FIG. 7 is a schematic diagram of a specific implementation of a display system in accordance with the invention in which the system is in the form of a workstation comprising a number of different system units connected via a system bus 43. The system bus comprises a data bus 44, an address bus 46 and a control bus 48. Connected to the system bus is a microprocessor 50, random access memory 52, a keyboard adapter 54, a display adapter 56, an I/O adapter 58 and a communications adapter 60. The keyboard adapter is used to connect a keyboard 62 to the system bus. The display adapter connects the system bus to a display device 64. The I/O adapter likewise provides a connection between other input/output devices 66 (eg. DASDs) and the system bus, and the communications adapter allows the workstation to be connected to and to communicate with an external processor or processors such as a host processor (not shown).

The display adapter is preferably implemented as special purpose hard-wired logic to take advantage of the speed of such logic. It could however be implemented with a high speed microprocessor and storage elements and appropriate code.

The display adapter includes an APA display buffer 30 which is not addressed directly by the processor 50. The display device can, however, access the display buffer in order to fetch the data corresponding to the individual picture elements on the screen. The data are fetched in synchronism with the scanning of the display screen. To facilitate this the information in the display buffer is organized in accordance with the scanning sequence of the display refresh circuitry.

The display buffer comprises an on-screen APA storage area and an off-screen APA storage area, as shown in FIG. 4 or FIG. 5. The on-screen storage area contains data indicative of pels to be displayed on the display device's screen and the off-screen storage is configured as a cache for containing the symbol definitions of symbols selected for display. The display adapter comprises hard-wired logic buffer control logic.

For a FIG. 4 type embodiment of the invention, the on-screen is for storing actual pel data for display and the buffer control logic is block transfer logic for copying blocks of data forming symbol definitions for selected symbols from the off-screen area to the on-screen area of the display buffer. For a FIG. 5 type embodiment of the invention, the on-screen is for storing, inter alia, pointers to symbol definitions in the off-screen storage area and the buffer control logic is merge control logic for merging data from the off-screen and the on-screen areas of the display buffer in order to refresh the display screen.

The cache control logic 42, 42' is implemented by means of suitable code which is held in general purpose RAM and is used to control the workstation processor to carry out the functions of that logic. The cache table, the symbol tables and the pointer are all configured in the workstation's general purpose RAM 52. Of course, the logic could equally be provided in the form of special purpose hard-wired logic, with one or more of the cache table, the symbol tables or the pointer provided in the form of special registers.

One form of block transfer logic which could be used in the display system of FIG. 4 is described in the Applicant's copending application Ser. No. 170,226, filed Mar. 18, 1988.

A detailed description of the actual format in which the data is stored has not been provided as this can take any one of a number of conventional forms. However, in order that the display may be scanned at a sufficiently high rate without resorting to expensive solutions, the image data for display is preferably stored in the display buffer in accordance with the scanning cycle for the display. The image data including the symbol definitions could be stored in the manner described in the Applicants' copending application Ser. No. 169,569, filed Mar. 17, 1988. In addition to the buffer control logic (ie. the block transfer logic or the merge control logic) described above, the display adapter 56 could also be provided with control logic such as that described in the aforementioned copending application for transferring blocks of data between the system bus of a workstation and a display buffer. Although in the copending application the disclosure effectively concentrates on the storing of blocks of data in an "on-screen" portion of a display buffer, it will be appreciated that the control logic described therein could also store a block of data such as a symbol definition in an off-screen part of the display buffer.

It will be appreciated that many modifications and/or additions to the particularly described embodiments are possible within the scope of the appended claims.

For example, as the cache control logic is implemented in software in the specific embodiments of the invention described above, a simple cache management algorithm, namely "clear when full" is used. Clearly, however, a more complicated cache management management algorithm such as "least recently used" could be employed, particularly if the cache control logic were implemented in special purpose logic. In practice the simple algorithm has proved to be effective because, on average in normal usage, only about 64 of the available 256 symbols in a symbol set are used between font changes. With a cache which can accommodate, for example, 128 symbol definitions the cache rarely becomes full therefore.

Also, although the present description has been particularly concerned with display systems in the form of workstations, it will be appreciated that the present invention is also applicable to display systems of the host-terminal type where the symbol tables are stored in the host and where there is only limited storage in the terminal for symbol definitions. In this sort of arrangement the cache control logic and cache table would be located in the host along with the symbol tables for the symbol definitions. The cache control logic would ensure that only the symbol definitions which are required for display are down loaded into the terminal in the same manner as described above for a workstation.

Having thus described my invention, what I claim as new, and desire to secure by Letters Patent is:

1. A display system comprising a symbol table in general purpose storage which includes blocks of data forming symbol definitions for each of a set of symbols forming a desired symbol set, an all points addressable (APA) display buffer which includes on-screen APA storage for data indicative of pels to be displayed on a screen and off-screen APA storage for symbol definitions, and buffer control logic for associating symbol definitions in off-screen APA storage with locations in on-screen APA storage such that symbols are displayed at desired locations on the display screen, wherein the display system additionally comprises cache control logic for copying the definition of a symbol for display from the symbol table in general purpose storage to off-screen APA storage if the definition for the selected symbol is not already held in off-screen APA storage, whereby the off-screen APA storage is configured as a cache for holding definitions for selected symbols.

2. A display system as claimed in claim 1 additionally comprising a cache table in general purpose storage comprising an entry for each symbol in the symbol set for pointing to the location in off-screen APA storage, if any, at which the corresponding symbol definition is held, each entry in the cache table also being associated with the location in the symbol table at which the corresponding symbol definition is stored.

3. A display system as claimed in claim 2 wherein a plurality of symbol tables for different symbol sets are stored in general purpose storage and wherein the display system is provided with pointer means under the control of the cache control logic for associating the cable table with the symbol table for the desired symbol set.

4. A display system as claimed in claim 3 in which the cache control logic is arranged to interrogate the cache table when a selected symbol is to be added to the display in order to identify the location, if any, at which the definition for the selected symbol is held in off-screen APA storage, and if the symbol definition is so held, to cause the buffer control logic to associate the selected symbol definition in off-screen APA storage with on-screen APA storage such that the symbol is displayed at a desired location on the display screen, otherwise to copy the definition for the selected symbol from the appropriate symbol table entry in general purpose storage to a free location in off-screen APA storage, to store an indication in the appropriate entry in the cache table of the location in off-screen APA storage at which the definition for that symbol is now held and to cause the buffer control logic to associate the selected definition in off-screen APA storage with on-screen APA storage such that the symbol is displayed at the desired location on the display screen.

5. A display system as claimed in claim 4 wherein the buffer control logic comprises block copy logic for copying the definitions for symbols to be displayed from off-screen APA storage to on-screen APA storage such that the symbols are displayed at desired locations on the display screen.

6. A display system as claimed in claim 4 wherein the buffer control logic comprises means for causing pointers to be stored in an on-screen APA storage to symbol definitions in off-screen APA storage and merge control logic for merging data from on-screen and off-screen APA storage for controlling the display such that the symbols are displayed at desired locations on the display screen.

7. In a computer graphics system, the combination comprising:

a display device;

at least one symbol table which includes blocks of data forming symbol definitions for each of a set of symbols forming a desired symbol set;

an on screen all points addressable (APA) display buffer for storing data indicative of pels to be displayed on said display device;

an off-screen APA storage for storing symbol definitions provided from said symbol table;

a buffer control logic for associating symbol definitions in said off-screen APA storage with pel locations in said on-screen APA display buffer such that symbols are displayed at desired locations on said display device; and storage control logic for determining if a selected symbol for display is presently stored in said off-screen APA storage, and if so transferring said selected symbol to said on-screen APA storage for display on said display device, and if not, transferring said selected symbol from said at least one symbol table to said off-screen APA storage.

8. The combination claimed in claim 7 including a storage table having an entry for each symbol in said symbol set for pointing to the location in said off-screen APA storage, if any, at which the corresponding symbol definition is stored, each entry in said storage table also being associated with the location in said at least one symbol table at which the corresponding symbol is stored.

* * * * *